US012385343B1

(12) United States Patent
Eriksen et al.

(10) Patent No.: US 12,385,343 B1
(45) Date of Patent: Aug. 12, 2025

(54) PLUG BREAKER

(71) Applicant: TCO Group AS, Indre Arna (NO)

(72) Inventors: Tommy Eriksen, Voss (NO); Richard Hagvåg Ringstad, Indre Arna (NO)

(73) Assignee: TCO Group AS, Indre Arna (NO)

( * ) Notice: Subject to any disclaimer, the term of this patent is extended or adjusted under 35 U.S.C. 154(b) by 0 days.

(21) Appl. No.: 19/186,848

(22) Filed: Apr. 23, 2025

(30) Foreign Application Priority Data

Dec. 13, 2024 (NO) ..... 20241225

(51) Int. Cl.
*E21B 23/04* (2006.01)

(52) U.S. Cl.
CPC ..... *E21B 23/0413* (2020.05)

(58) Field of Classification Search
CPC .. E21B 2200/06; E21B 23/0413; E21B 23/04; E21B 34/103
See application file for complete search history.

(56) References Cited

U.S. PATENT DOCUMENTS 11,808,109 B1 11/2023 Conner et al.
2008/0196903 A1* 8/2008 Wardley ..... E21B 21/12 166/387
2013/0014941 A1* 1/2013 Tips ..... E21B 23/0412 166/250.15
2013/0186633 A1* 7/2013 Kitzman ..... E21B 23/04 166/318
2014/0083713 A1* 3/2014 Budler ..... E21B 33/14 166/373
2014/0251629 A1* 9/2014 Castro ..... E21B 34/14 166/318
2015/0129205 A1* 5/2015 Hofman ..... E21B 34/103 166/250.01

(Continued)

OTHER PUBLICATIONS

Norwegian Search Report for Serial No. 20241225; issued Apr. 8, 2025.

*Primary Examiner* — Shane Bomar
(74) *Attorney, Agent, or Firm* — Flener IP & Business Law; Zareefa B. Flener

(57) ABSTRACT

A soft open preventer system including: a preventer tubular, a soft open preventer, a channel system, and a downhole tool. The soft open preventer includes a preventer support and a preventer release element. The channel system includes a channel, a channel release, and pressure applier. The downhole tool includes a tool release element. The soft open preventer, the downhole tool, and the channel system is arranged at least partially in the preventer tubular. The soft open preventer is arranged such that the downhole tool will not activate before the soft open preventer activates. The pressure applier is arranged to activate the channel release, the channel release is arranged to allow pressure to increase in the channel, and the channel is in fluid contact with at least a portion of the preventer support. The preventer release element supports the preventer support and is arranged such that when a threshold absolute pressure or pressure differential is applied to the preventer release element, the preventer release element breaks activating the soft open preventer. This allows the preventer support to move. The preventer system is arranged such that activation of the soft open preventer will allow the activation of the downhole tool.

20 Claims, 13 Drawing Sheets

(56) References Cited

U.S. PATENT DOCUMENTS

| | | | | |
|---|---|---|---|---|
| 2017/0211351 | A1* | 7/2017 | Graf | E21B 34/066 |
| 2018/0171737 | A1* | 6/2018 | Xu | E21B 29/02 |
| 2018/0252073 | A1* | 9/2018 | Richards | E21B 47/12 |
| 2018/0328144 | A1* | 11/2018 | Arabsky | E21B 23/006 |
| 2019/0078408 | A1 | 3/2019 | Fripp | |
| 2020/0362668 | A1* | 11/2020 | Fripp | E21B 34/063 |
| 2023/0243229 | A1* | 8/2023 | Eriksen | E21B 33/134 166/179 |
| 2023/0279736 | A1* | 9/2023 | Eriksen | E21B 17/1078 166/192 |
| 2023/0358114 | A1* | 11/2023 | Dyck | E21B 33/13 |
| 2023/0400059 | A1* | 12/2023 | Eriksen | F16J 15/022 |
| 2024/0279994 | A1 | 8/2024 | Decuir et al. | |

* cited by examiner

PLUG BREAKER

FIELD OF INVENTION

The invention is in the field of systems to activate a downhole tool, exemplified by the breaking of a frangible plug. More specifically it relates to a channel providing force onto a component that is not dependent on the pressure differential downhole of the tool. Also, it relates to the activation of a sleeve, or the breakage of a frangible plug with breakers located above said plug.

BACKGROUND

Many downhole tools can be activated by applying pressure. This can be easily done by pumping from above and is often preferable to more complicated activation means that require wirelines, ball drops, signals of various kinds like RFID or chemical activation. Many pressure activated systems require a counter that counts pressure cycles, but in its simplest form a single pressure spike, above what would normally occur in the well, can be enough for tool activation. In either case, it is of course important that the tool activates at the correct predetermined pressure.

The pressure increase often needs to be not too gradual. This is because mechanical activation by pressure usually is a result of some part being moved, and if the pressure is applied too slowly this might not happen. For example, if a frangible plug blocking a pipe is to be removed by driving a breaker object into said plug, the breaker needs to contact the plug at speed, or the plug might not break at the pressure it was designed to do so.

If a pressure activated tool fails to be activated at the preset intended pressure due to a too slow pressure increase, the well operator will have to crank up the pressure, and subject the well to more pressure than was intended or desired. This could have detrimental effects on the well or activate other tools to be activated at a higher pressure. For the mentioned frangible plug this slow breaking of the plug is what one could name a "soft open", rather than a normal opening where the plug is opened quickly as a breaker makes contact with the plug at considerable speed.

Frangible plugs are plugs that are brittle and are usually made of materials such as glass or ceramics. Unlike most materials, such materials are not corroded by the chemical well environment, nor do they change properties noteworthy with pressure and temperature. They are also very strong, so they can hold very high pressures without breaking outright. But due to their frangible nature, when subjected to point forces, such as can be provided by a knife edge or round surface (herein referred to as a breaker), they will shatter and break into small pieces and leave the pipe open. When the plug is frangible the resulting pieces will usually be small enough not to interrupt well operations, and if they are not a debris catcher can be used. Such frangible plugs are used for a variety of purposes where temporarily plugging of a well pipe (casing or liner) is desired, such as during completion or flotation.

For a simple frangible plug system, either the plug or breaker is able to move into the other but is prevented from doing so by something holding it in place; a tool release element. This something is typically a shear element such as a shear ring or shear pins that shear off when enough pressure is applied. If there is not sufficient pressure, or said pressure is increased too slowly, the shear element will shear but there might not be enough force for the breaker to impact the plug hard enough to break. This can also happen if the shear element is mistuned, or the tuning miscalculated, or if the well conditions are very different from what was expected, such as more viscous fluids or debris making it harder for parts to move, or if there is a surge of pressure from below the plug or a fluctuation in the pressure applied from above. It is possible that the pressure differential across the plug causes the plug or breaker to release but does not have sufficient force to break the plug. Regardless of the specific reasons for the "soft opening", the results are that the frangible plug and breaker are slowly brought in contact and then just rest in contact, no breaking occurs. Then it has become much harder to break the plug, as it or the breaker now cannot build up speed and slam into one another as there is no moving distance to build up said speed over. Therefore, more pressure than was intended or desired must then be applied to break and open the plug, or it may not be possible to apply enough energy to break the plug.

The same kind of soft open problems as the soft opening of frangible plugs apply to other well tools that are to be activated by pressure. For example, sleeves that are to be moved by pressure can get stuck when moved only partially, and then need more pressure to be moved fully into their desired end position. Such a sleeve could have many uses, such as opening and closing passages leading fluids through the pipe wall, for example bypassing a plug, or the sleeve itself could act as a breaker for a plug, or engage another tool to activate it. Usually well tools activated by pressure are sold as an enclosed product, ready to be attached in line with the work string.

The present invention provides a solution to the soft opening problem described above in the form of a soft open preventer system. The operating principle of the preventer is to allow the pressure from the well to come through a valve when the valve opens. The opening of the valve is triggered by something, such as manually, by an electric signal conveyed by wireline, a pressure activated electric signal, or a mechanical counter. A pressure activated electric signal or so-called e-trigger is when a specific pressure pattern is recognized and leads to a mechanical part being moved. A mechanical counter has an indexing system that moves/counts pressure pulses of a certain strength and then, after a predetermined number of cycles, leads to a mechanical part being moved. There are many ways of opening the valve, the important thing is that until this happens, the pressure from the well cannot be transmitted through the valve. This then allows the tool to be activated to experience the pressure the valve transmits, so that it can activate. In the example of a frangible plug to be broken by a breaker, the tool release element is then after the valve opening, and only then, allowed to experience the well pressure, and the frangible plug can be broken. So while the opening of the valve is necessary to allow the tool release element to experience the well pressure, the tool release element itself determines when the frangible plug is opened depending on what pressure it is tuned to. Therefore, it is possible to use two different shear elements for opening a frangible plug, tuned differently, so that one of said shear elements is tuned to pend the valve at a set pressure, while another shear element is set to break the plug at a different pressure. Thus, the soft open preventer acts as a guarantee that the frangible plug opening occurs when the differential pressure is above the desired limit such that the plug will break.

Usually, a frangible plug is operated as a single cycle barrier ("pump open") and uses a shear device that opens the very first time the differential pressure reaches a limit. However, with a soft open preventer it is possible to operate the plug system in as a multicycle barrier. A multicycle barrier is one in which the pressure can be repeatedly increased greater than the limit of that would open a single cycle barrier. A multicycle valve can be operated several times to the full rated maximum pressure, and then opened at a lower applied pressure or pressure differential.

Advantages of the Present Invention

Some of the advantages of some or all of the examples disclosed include:

- Reduces the chance of the plug not being broken if there is enough pressure differential across the plug to cause it to enter a breaking activation, but insufficient force to break it.
- Allows a frangible plug to be broken not based upon a differential pressure across the plug.
- Allows the pressure to be increased past the pressure differential or absolute pressure sufficient to break the plug, without trigging the mechanism that results in the plug being broken.
- Allows for multiple kinds of release elements to be used.
- Allows for a pressure differential across the soft open preventer (not across the plug) and not an absolute pressure to activate a tool.
- Allows the plug soft open tubular system to be operated in a multicycle.
- Allows for an alternative way to activate a downhole tool.
- Allows for an unmoving frangible plug to be broken.
- Other advantages are derivable from the disclosure.

SHORT SUMMARY OF THE INVENTION

In some aspects, the techniques described herein relate to a soft open preventer system including: a preventer tubular, a soft open preventer, a channel system, a downhole tool, where the soft open preventer includes: a preventer support, and a preventer release element, and the channel system includes a: a channel, a channel release, and pressure applier; and the downhole tool includes: a tool release element; wherein: the soft open preventer, the downhole tool, and the channel system is arranged at least partially in the preventer tubular; and the soft open preventer is arranged such that the downhole tool will not activate before the soft open preventer activates; the pressure applier is arranged to activate the channel release, the channel release is arranged to allow pressure to increase in the channel; the channel is in fluid contact with at least a portion of the preventer support, and the preventer release element supports the preventer support; wherein: the preventer release element is arranged such that when a threshold absolute pressure or pressure differential is applied to the preventer release element, the preventer release element breaks activating the soft open preventer, allowing the preventer support to move; and preventer system is arranged such that activation of the soft open preventer will allow the activation of the downhole tool.

In some aspects, the techniques described herein relate to the soft open preventer system, wherein the downhole tool further includes a tool release element, wherein the downhole tool activates when the tool release element breaks.

In some aspects, the techniques described herein relate to the soft open preventer system, wherein the preventer release element and the tool release element is a single element.

In some aspects, the techniques described herein relate to the soft open preventer system, wherein the soft open preventer further includes a preventer sleeve that supports the preventer support.

In some aspects, the techniques described herein relate to the soft open preventer system, wherein the pressure applier is a counter.

In some aspects, the techniques described herein relate to the soft open preventer system, wherein the pressure applier is an electronic trigger.

In some aspects, the techniques described herein relate to the soft open preventer system, wherein the channel is arranged in the preventer tubular.

In some aspects, the techniques described herein relate to the soft open preventer system, wherein the preventer release element is a shear element.

In some aspects, the techniques described herein relate to the soft open preventer system, wherein the preventer release element is a tension element.

In some aspects, the techniques described herein relate to the soft open preventer system, wherein the preventer release element is a tensile element.

In some aspects, the techniques described herein relate to the soft open preventer system, wherein the preventer release element is a crumple element.

In some aspects, the techniques described herein relate to the soft open preventer system, wherein the tool release element is a shear element In some aspects, the techniques described herein relate to the soft open preventer system, wherein the tool release element is a tension element.

In some aspects, the techniques described herein relate to the soft open preventer system, wherein the tool release element is a tensile element.

In some aspects, the techniques described herein relate to the soft open preventer system, wherein the preventer support and/or preventer sleeve is an axially movable sleeve.

In some aspects, the techniques described herein relate to the soft open preventer system, wherein the preventer support and preventer sleeve are a single element.

In some aspects, the techniques described herein relate to the soft open preventer system, wherein the preventer release element is arranged between the preventer sleeve or in the preventer support, and an element that is stationary with respect to the preventer tubular.

In some aspects, the techniques described herein relate to the soft open preventer system, wherein the preventer support is arranged to prevent the tool release element from breaking.

In some aspects, the techniques described herein relate to the soft open preventer system, wherein the downhole tool activates simultaneously with when the soft open preventer activates.

In some aspects, the techniques described herein relate to the soft open preventer system, wherein the preventer release element breaks simultaneously or shortly after the tool release element.

In some aspects, the techniques described herein relate to the soft open preventer system, wherein the downhole tool is a plug assembly, wherein the plug assembly includes: a plug that blocks fluid flow through the preventer tubular when the plug is intact; and a seat that supports the plug, wherein the plug assembly is configured to break the plug after the plug assembly activates.

In some aspects, the techniques described herein relate to the soft open preventer system, wherein the plug assembly further includes a breaker assembly, wherein the breaker assembly includes a breaker object, wherein the breaker object is arranged to break the plug on contact, preferably by axial movement between the plug and the breaker object.

In some aspects, the techniques described herein relate to the soft open preventer system, wherein the plug assembly wherein: the tool release element is a plug release element; wherein the plug release element is arranged bring the breaker object in contact with the plug when the plug release element breaks.

In some aspects, the techniques described herein relate to the soft open preventer system, wherein the plug assembly is arranged such that the seat moves axially when the plug release element breaks.

In some aspects, the techniques described herein relate to the soft open preventer system, wherein the preventer support supports the seat.

In some aspects, the techniques described herein relate to the soft open preventer system, wherein the seat and the preventer support is a single element.

In some aspects, the techniques described herein relate to the soft open preventer system, wherein the plug release element is the preventer release element.

In some aspects, the techniques described herein relate to the soft open preventer system, wherein: the plug release element includes a shear ring body and a shear ring lip, and the shear ring lip supports the seat; wherein the preventer support supports the shear ring lip.

In some aspects, the techniques described herein relate to the soft open preventer system, wherein the downhole tool includes a sleeve and wherein In some aspects, the techniques described herein relate to the soft open preventer system is arranged such that activation of the sleeve activates the downhole tool.

In some aspects, the techniques described herein relate to the soft open preventer system, wherein the plug assembly further includes a breaker assembly wherein the breaker assembly includes: the breaker object, and a breaker support; wherein the breaker object is supported by the breaker support, the breaker support is supported by the preventer support; and wherein: the breaker support supports the breaker object, and wherein the activation of the soft open preventer allows the breaker assembly to activate.

In some aspects, the techniques described herein relate to the soft open preventer system, wherein the preventer support and the breaker support are a single piece.

In some aspects, the techniques described herein relate to the soft open preventer system, wherein the plug is stationary.

In some aspects, the techniques described herein relate to the soft open preventer system, wherein In some aspects, the techniques described herein relate to the soft open preventer system further includes a: a second downhole tool, a second channel, and a second soft open preventer; wherein In some aspects, the techniques described herein relate to the soft open preventer system is arranged such that: the second channel is in fluid connection with the channel after the first soft open preventer activates, and the channel second channel is in fluid connection with the second soft open preventer.

In some aspects, the techniques described herein relate to the soft open preventer system, wherein In some aspects, the techniques described herein relate to the soft open preventer system further includes a: a second downhole tool, a second channel, and a second soft open preventer; wherein In some aspects, the techniques described herein relate to the soft open preventer system is arranged such that: the second channel is in fluid connection with the channel before the first soft open preventer activates, and the channel second channel is in fluid connection with the second soft open preventer.

In some aspects, the techniques described herein relate to the soft open preventer system, wherein the second downhole tool is a plug assembly.

BRIEF DESCRIPTION OF THE FIGURES

The above and further features of the invention are set forth with particularity in the appended claims and advantages thereof will become clearer from consideration of the following detailed description. Embodiments of the present invention will now be described, by way of example only, with reference to the following diagrams wherein:

REFERENCE NUMBERS AND CORRESPONDING ELEMENTS

Figure 1A:
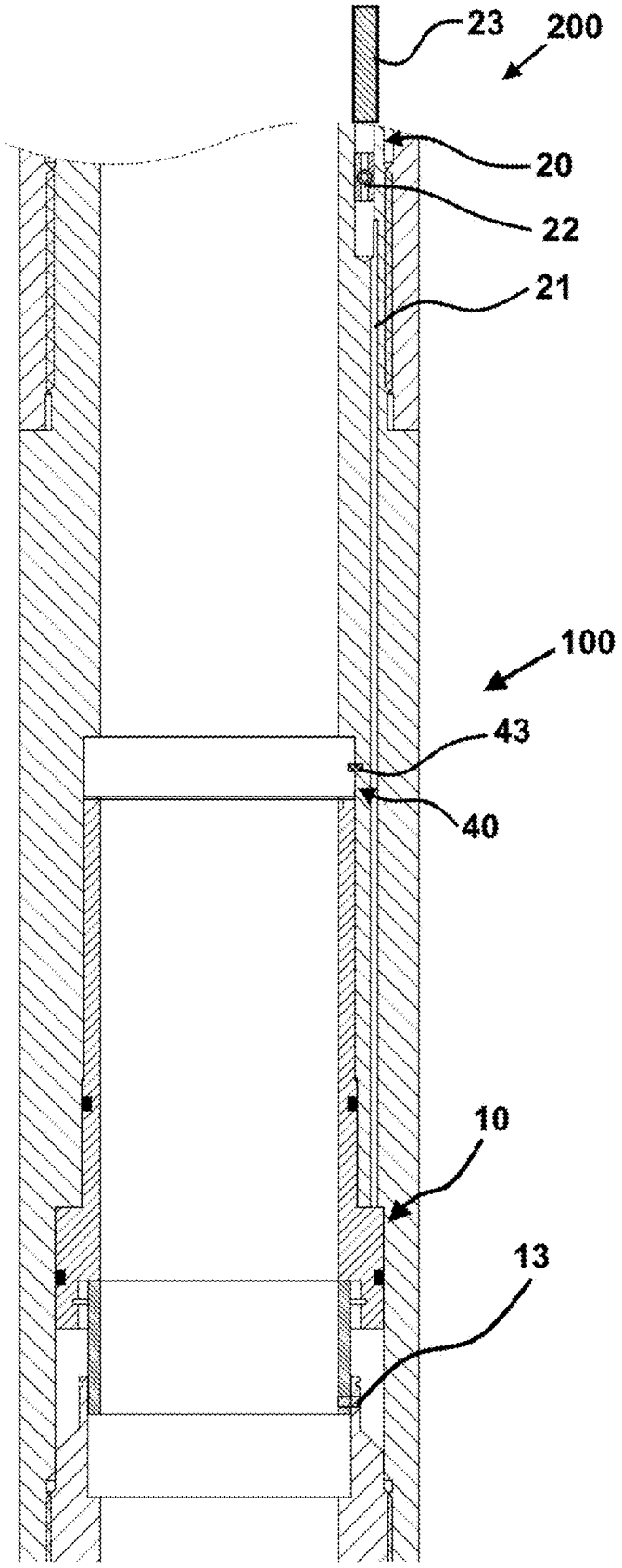
FIG. 1A discloses a cross-sectional side view of a soft open preventer system with a general downhole tool.

10 Soft Open Preventer 10
11 Preventer support 11
12 Preventer sleeve 12
13 Preventer release element 13
14 Sleeve Snap Ring 14
15 Preventer Gap 15
16 Bearing Ring 16
20 Channel System 20
21 Channel 21
22 Channel Release 22
23 Pressure Applier 23
30 Plug Assembly 30
31 Plug 31
32 Seat 32
33 Plug Release Element 33
331 Plug Release Body 331
332 Plug Release Fingers 332
333 Shear Ring Body 333

334 Shear Ring Lip 334
34 Breaker Object 34
35 Housing 35
36 Sealing Elements 36
37 Breaker Assembly 37
38 Breaker Support 38
39 Breaker Body 39
40 Downhole Tool 40
43 Tool Release Element 43
60 Sleeve 60
63 Sleeve Release Element 63
100 Preventor Tubular 100
101 Upstream tubular 101
102 Downstream tubular 102
200 Soft open preventer system 200

DETAILED DESCRIPTION OF THE INVENTION

Reference will now be made in detail to the present embodiments of the invention, examples of which are illustrated in the accompanying drawings. Alternative embodiments will also be presented. The drawings are intended to be read in conjunction with both the summary, the detailed description, and any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art.

The present invention is a soft open preventer system that is arranged in a housing in the tubular. While this will function with a general downhole tool, most of the specific disclosure will be on plug assemblies and downhole tools that include a sleeve.

The following describes a plug assembly and a soft open preventer that activates with a pressure differential between the pressure uphole on the plug and the pressure downhole on the plug. The soft open preventer and plug assembly do not need to activate at the same pressure differential.

In the first position, the plug rests on a seat, is intact, and prevents fluid flow through the tubular. The seat is supported by a soft open preventer. A fluid channel is arranged to apply pressure to the soft open preventer. Both the soft open preventer and plug assembly are stationary.

In the second position, a pressure applier opens the channel release and allows the uphole pressure to reach the soft open preventer. A threshold pressure differential in the fluid channel is applied such that at least a portion of the soft open preventer moves in an axial direction. In the third position, after a threshold differential pressure is applied to the plug, the plug assembly activates, a portion of the plug assembly moves, and brings the plug into contact with the breaker object. In the fourth position, the plug is broken, and fluid flow is restored through the preventer system.

Note that the invention can be arranged such that it is the pressure from downhole that triggers the breaking of the plug, but it is more common with pressure from uphole being used for that purpose.

Direction terms such as up, down, left, right, above, below, etc. are being used in reference to the orientation of the elements in the figures. In no way is this intended as limiting. It is possible to run the soft open preventer, the channel system, or the plug assembly independently in an opposite manner as described. For example, the triggering can be determined by the pressure from the downhole side.

Reference is made to FIG. 1A. FIG. 1A discloses a cross-sectional side view of a soft open preventer system 200 in the first position for a general downhole tool 40.

The soft open preventer system 200 comprises a preventer tubular 100, a, soft open preventer 10, channel system 20, and a downhole tool 40. The soft open preventer 10 prevents the downhole tool 40 from activating prematurely. Usually, the soft open preventer 10 does this by preventing one or more elements of the downhole tool 40 from moving.

The channel system 20 comprises a channel 21, a channel release 22, and a pressure applier 23. The channel release 22 in almost all of the figures is a release valve. However, this specific channel release 22 is not the only one that would be acceptable. Other examples include other kinds of valves and burst disks. The important factor of channel release 22 is that it stops the fluid pressure connection between the pressure through the preventer tubular 100 and the channel 21 and can be opened (thus the channel system 20 activates) by the pressure applier 23. It is the function of the channel release 22 to activate when it is time for the soft open preventer 10 to experience pressure from uphole. In the disclosed figures, channel 21 is arranged in the preventer tubular 100. Other options are possible.

The pressure applier 23 shown in the figures is a counter. However, this is a specific type of pressure applier. The function of the pressure applier 23 is to activate the channel system 20 by triggering the channel release 22 such that pressure from uphole is applied to the soft open preventer 10. Examples of other suitable means are mechanical or pulse counters, electronic triggers, release valves, acoustic signals, and pressure sensors. In the case of counters, at a certain count (normally specified by the number of pressure cycles) the channel release 22 opens and exposes channel 21 to pressure from the uphole side of the plug. In the case of electric triggers, they are usually triggered by following a "pressure key" of specific pressures or pressure pulses and durations. In the case of a pressure sensor, channel release 22 will usually be configured to open once a threshold absolute pressure has been applied.

Eventually, pressure applier 23 will open the channel release 22 and the pressure from uphole will be enough so that the preventer release element 13 breaks. It is possible for the pressure applier 23 and the channel release 22 to be one element that fulfills both roles. Please note that both the preventer release element 13 or the plug release element 33 can be configured to work by absolute pressure instead of differential pressure.

When the threshold differential pressure (or absolute pressure) across the soft open preventer 10 is high enough through the channel system 20, the soft open preventer 10 will move. The activation of the soft open preventer 10 will then allow the downhole tool 40 to activate. This activation can occur simultaneously with the activation of the soft open preventer 10, or at a later time.

The tool release element 43 is shown in FIG. 1A as arranged between the housing in the preventer tubular 100 and a downhole tool 40. However, this is a general schematic of a downhole tool 40 and a tool release element 43. The tool release element 43 is arranged somewhere in the downhole tool 40. It breaks and the downhole tool 40 activates after the soft open preventer 10 activates. The exact location of the tool release element 43 could be different for different downhole tools 40.

Later examples will include where the downhole tool is a plug assembly 30 or a sleeve 60. In these cases, the tool release element 43 is either a plug release element 33 or a sleeve release element 63. If these elements are not present, then the release elements 43,33,63 can be considered to be the preventer release element 13.

Figure 1B:
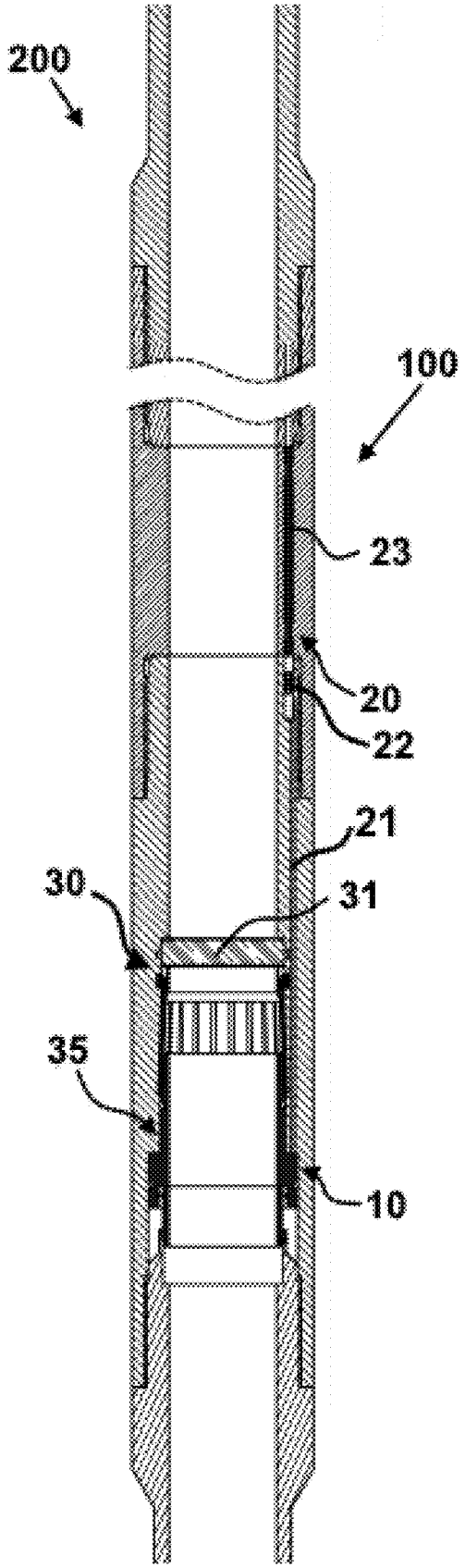
FIG. 1B discloses a cross-sectional side view of a soft open preventer system where the downhole tool is a plug assembly.

Reference is made to FIG. 1B. FIG. 1B discloses a cross-sectional side view of a soft open preventer system 200 in the first position where the downhole tool 40 is a plug assembly 30. The function and operating principles of channel system 20 and soft open preventer 10 is the same as for FIG. 1A for a general downhole tool.

The function of the plug assembly is to break a plug 31 that is providing a temporary barrier to fluid flow through the preventer tubular 100.

The soft open preventer 10, channel system 20, and plug assembly 30 are arranged in the housing 35. The housing is the portion of the soft open preventer system 200 (usually the preventer tubular 100) that has been shaped to accommodate the soft open preventer 10, channel system 20, and plug assembly 30. Other elements and assemblies can also be accommodated in the housing 35. It is possible for the housing 35 to be arranged in an element between the preventer tubular 100 and some or all of the other elements in the soft open preventer system 200.

It is common with a plug assembly 30 that operates purely on the pressure differential experienced across plug 31. However, it is possible that the plug assembly moves from the first position (plug intact as in FIG. 2A) without sufficient force to break the plug 31. This is referred to as a soft release. The soft open preventer 10 is designed such that it is not the pressure differential across the plug that causes the plug assembly 30 to release the plug 31, rather it is the fluid threshold differential pressure through channel system 20 applying pressure on the soft open preventer 10. When the threshold differential pressure across the soft open preventer 10 is high enough through channel system 20, the soft open preventer 10 will move. This in turn will ensure that when plug 31 experiences enough threshold differential pressure plug 31 breaks and reopen flow through the soft open preventer system 200 (shown in FIG. 2D).

The soft open preventer 10 prevents the plug assembly 30 from activating with the absolute uphole pressure or pressure differential. The soft open preventer 10 allows the plug assembly 30 to experience a pressure greater than that required to activate the plug assembly 30 and break the plug 31. It this way, the soft open preventer system 200 can be cycled through multiple pressure values before the plug assembly 30 activates. This is sometimes referred to as a multicycle plug assembly 30 (as opposed to a single cycle plug assembly 30 where once the threshold differential pressure is reached, it activates). When it is time to break the plug 31, the pressure applier 23 opens the channel release 22 and allows pressure in the channel system 20 to activate the soft open preventer 10. Then the plug assembly 30 is allowed to activate.

Depending on the exact configuration, it can be easier to set the threshold differential pressure of the preventer release element 13 rather than simply increasing the threshold differential pressure of the plug release element 33.

Note that soft open preventer 10 does not need to be located below plug assembly 30 or the plug 31.

Reference is made to FIGS. 2A-2D that disclose first to fourth position of the soft open preventer system 200.

Figure 2A:
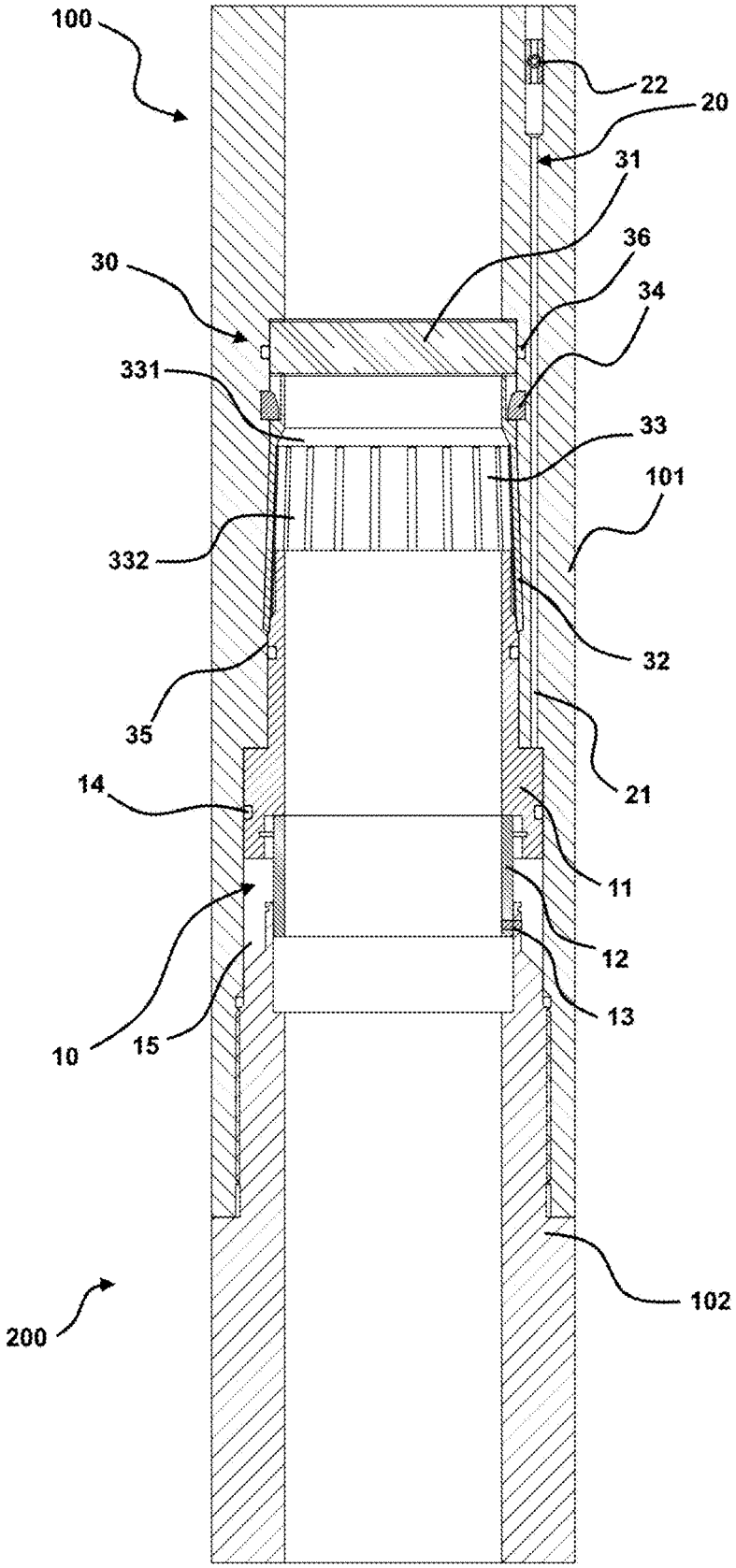
FIG. 2A discloses a closeup cross sectional view of an example of a soft open preventer system in the first position.

Reference is made to FIG. 2A. FIG. 2A discloses a close-up cross-sectional view of the soft open preventer system 200 in a first position. The uphole side is on the top of the figure and the downhole side is on the bottom of the figure. As above, the soft open preventer system 200 comprises a preventer tubular 100, in which a soft open preventer 10, channel system 20, and plug assembly 30 is arranged in a housing 35 of the preventer tubular 100. The soft open preventer 10 supports the plug assembly 30. Fluid in the channel system 20 applies pressure to the soft open preventer 10.

The preventer tubular 100 is comprised of the upstream tubular 101 and the downstream tubular 102. As mentioned previously, the housing 35 can be a separate element and/or a portion of the preventer tubular 100.

The soft open preventer 10 comprises a preventer support 11, preventer sleeve 12, preventer release element 13, and sleeve snap ring 14. Pressure on the soft open preventer 10 is applied to the preventer support 11 through a channel system 20. The channel system 20 comprises a channel 21.

In the example shown in the figure it also includes a channel release 22. The channel release 22 blocks the pressure from the pressure uphole from reaching the channel 21.

The preventer support 11 is supported by the preventer sleeve 12. The preventer sleeve 12 is connected by a preventer release element 13 to the downstream tubular 102. When the preventer release element 13 breaks, the soft open preventer 10 moves. In the figure then preventer support 11 moves into the preventer gap 15. The preventer gap 15 is dimensioned such that the gap is deep enough such that the soft open preventer 10 moves far enough such that the plug 31 makes the contact with the breaker object 34 and breaks.

When the pressure through channel 21 is above the threshold differential pressure of the preventer release element 13 (arranged between the preventer sleeve 12 and the preventer tubular 100), it actives the soft open preventer 10. This allows the soft open preventer 10 to move such that the plug 31 of the plug assembly 30 can move. In the example shown, the preventer release element 13 is arranged between the downstream tubular 102 and the preventer sleeve 12. When the preventer release element 13 breaks, the preventer sleeve 12 moves causing the preventer support 11 to move. This in turn will cause seat 32 to move. A sleeve snap ring 14 locks the soft open preventer 10 in place such that it will not move upwards. In this example, it is arranged on the preventer support 11.

By the phrase "the preventer release element 13 or the plug release element 33 breaks", it is referring to the behavior that results in the release elements changing shape allowing the parts to move. Examples of this "breaking" of a release element are when the shear ring breaks or shears into at least two pieces, a tension type of release element collapses or expand, a tensile element stretching until breaking, a sleeve overcoming the friction that is holding an element in place, or a compression element crumpling. Both the preventer release element 13 and the plug release element 33 can be of the types of release elements 13,33 mentioned above.

Note that the preventer release element 13 can be arranged along the preventer support 11 or preventer sleeve 12, or part of the preventer support 11 or preventer sleeve 12 itself. It is possible for the preventer sleeve 12 (or any other element designed as a "sleeve") to not form a ring. For example, it could be half or quarter sleeve.

The role of the pressure applier 23 is to operate independent of the pressure differential across the plug. The soft open preventer 10 acts as a guarantee that the opening occurs when the differential pressure across the plug 31 is above the desired limit to break the plug.

The plug assembly 30 comprises a plug 31, seat 32, plug release element 33, breaker and a breaker object 34. The plug assembly 30 is arranged in a housing 35, and sealing elements 36 are shown to prevent fluid from traveling around the plug 31. These elements 36 do not always seal entirely, depending on the application. The plug 31 is supported by the seat 32. A plug release element 33 is arranged such that when threshold pressure differential is applied, it collapses or breaks. The plug 31 is the able to move in an axial direction towards the breaker object 34 until it makes contact with the plug 31 (as shown in FIG. 2C). Seat 32 is supported by soft open preventer 10, in this case the preventer support 11. When the preventer release element 13 breaks due to pressure in the channel system 20, it ensures that there is enough differential pressure so that when the plug release element 33 collapses, the plug 31 will break on the breaker object 34.

The sealing element 36 is shown as being parallel to the preventer tubular 100, however this is an example. Other examples include sealing between a chamfered angle on the plug and the preventer tubular 100. Another example is between a sloped portion in the housing 35 and the plug 21.

The purpose of the breaker object 34 is to simply break whatever it contacts, in this case a plug 31. The breaker object 34 does not need to break the plug 31 on contact, but by the time it reaches the final position. For a plug 31 there are many known types of breakers including: knives, explosives, crushers, studs, spikes, balls, and so on. These are well known in the art.

Figures 5A, 5B:
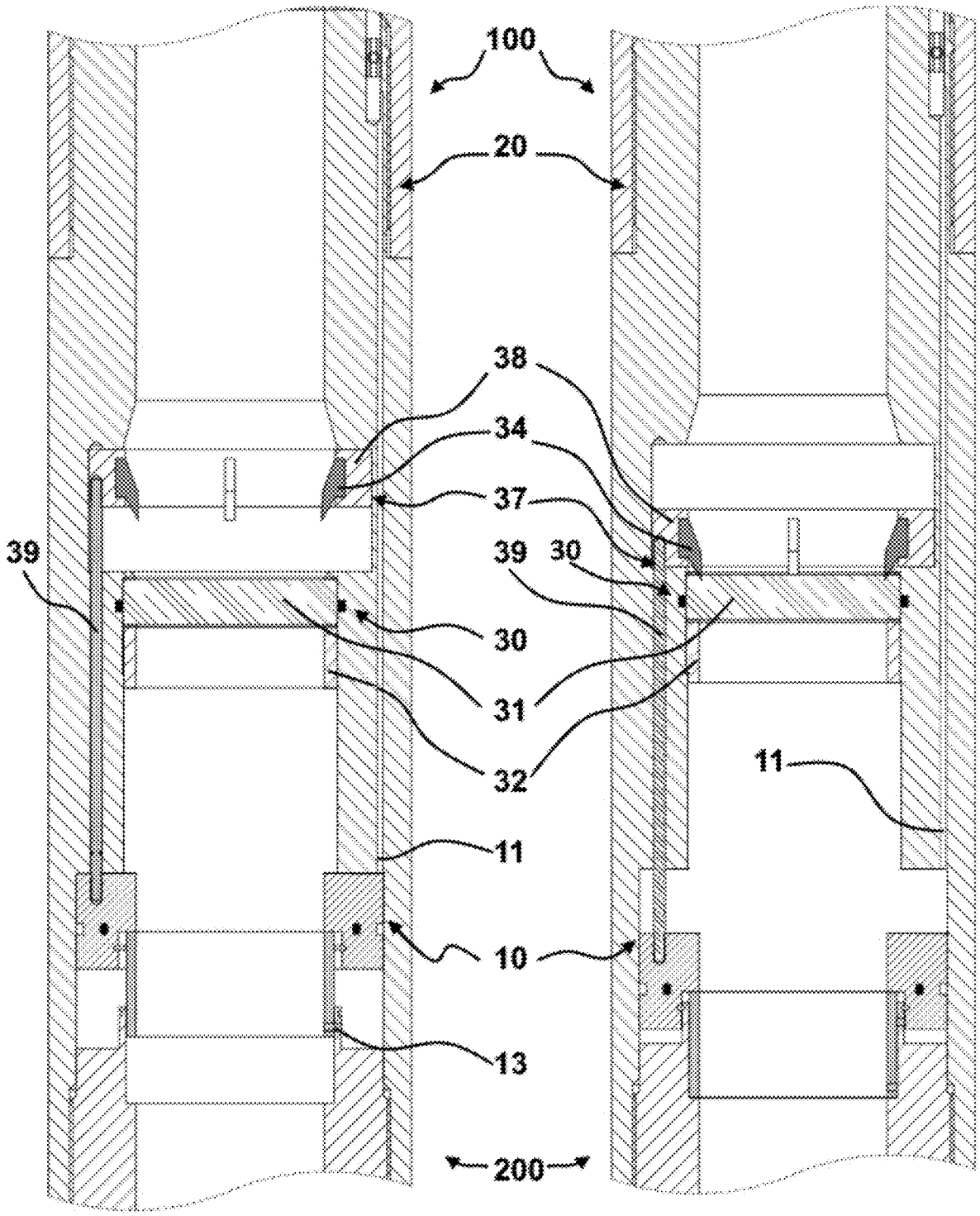
FIGS. 5A and 5B disclose a cross-sectional view of a fourth example of a soft open preventer system with a different breaker object.

The breaker object 34 is shown as being located in the housing 35, however the location can be in different places. The important role of the breaker object 34 is that it breaks the plug 31 in the fourth position, but it doesn't need to shatter the plug 31 on contact, but between the third and fourth position. Normally the breaking will occur very quickly after the plug 31 impacts the breaker object 34. The location of the breaker object 34 is not important, but the breaker object 34 should be moving toward the plug 31 with respect to the plug 31. Most of the figures show that the breaker object 34 is stationary, but FIGS. 5A-B shows the breaker object 34 moving. If the plug 31 was also moving, it would be possible for the breaker object 34 to still make contact depending on relative speeds between the plug 31 and breaker object 34.

The example of a plug release element 33 that is disclosed in FIG. 2A-2D is one that uses tension. The plug release element 33 comprises a plug release body 331 with plug release fingers 332 extending from it. The plug release fingers 332 are biased outwards and prevent the seat 32 from moving toward the breaker object 34. Once the preventer release element 13 of the soft open preventer 10 breaks due to pressure in channel system 20, the preventer support 11 moves downwards. It is then the plug release element 33 that prevents the plug assembly 30 from entering the second position.

Note that in this example, the preventer support 11 prevents the plug 31 from moving because there is no space for it to move inwards. This region has been outlined with a dotted circle in FIG. 2B.

Figure 2B:
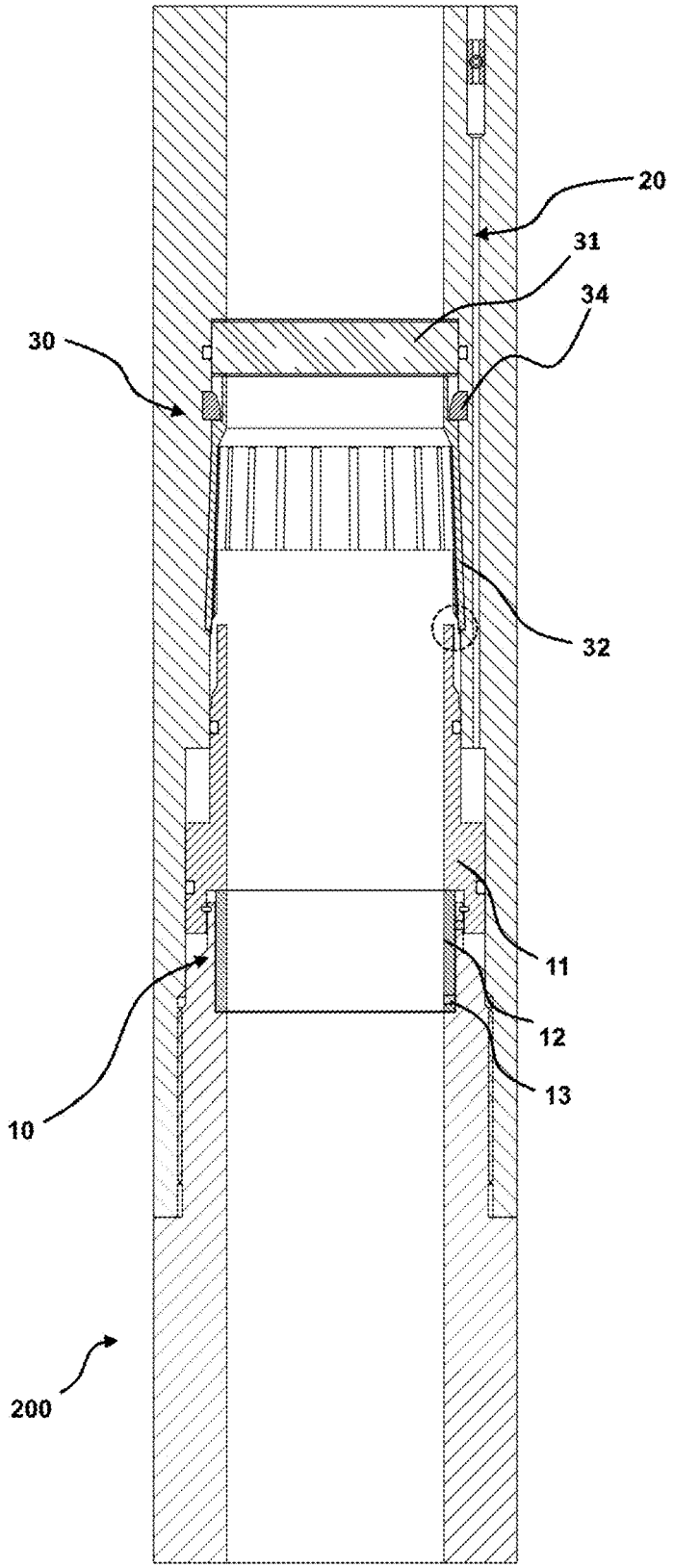
FIG. 2B discloses a closeup cross sectional view of an example of a soft open preventer system in the second position.
Figure 2C:
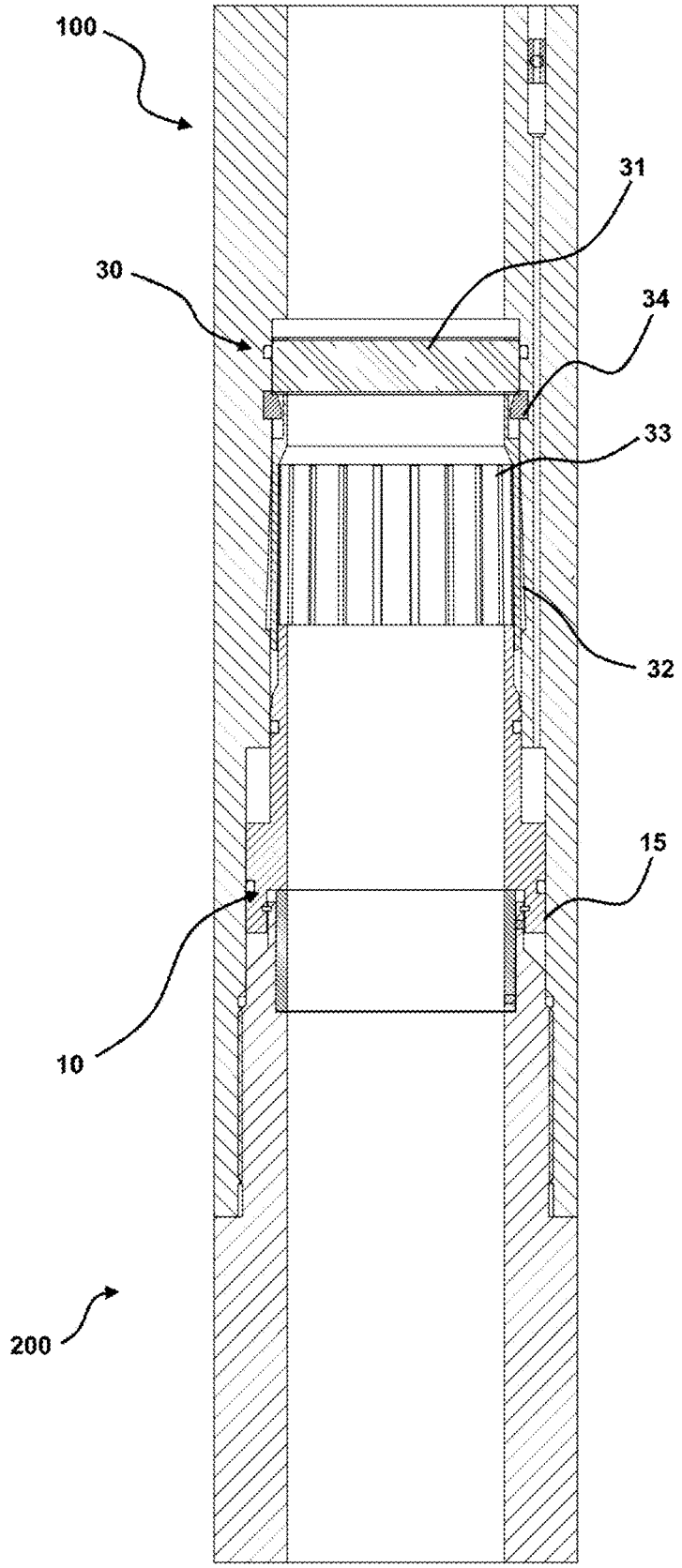
FIG. 2C discloses a closeup cross sectional view of an example of a soft open preventer system in the third position.

FIG. 2B discloses the same view as FIG. 2A, but the soft open preventer system 200 is in the second position. In the second position, the pressure from the channel system 20 is high enough to overcome the preventer release element 13 in the soft open preventer 10 and the soft open preventer 10 has moved. In this specific example, the movement of the preventer support 11 allows the possibility that the seat 32 will move. This region has been outlined with a dotted circle. One skilled in the art would be able to arrange the soft open preventer 10 and the plug assembly 30 such that it would not be possible for the plug 31 to break before the soft open preventer 10 has moved.

FIG. 2C discloses the same view as FIG. 2A and FIG. 2B, but the soft open preventer system 200 is in the third position. In the third position, the soft open preventer 10 has moved and a threshold pressure differential is applied to the plug such that the plug release element 33 has collapsed or broken. The seat 32 of the plug assembly 30 has moved until the plug 31 is in contact with the breaker object 34. In many cases the third position occurs simultaneously with, or shortly after, the second position. An advantage of this is that the plug can break at the lowest pressure needed to ensure that there is enough force, such that the plug will break. Between the first position and the third position, both the soft open preventer 10 has moved, and the plug release element 33 has changed its state due to a pressure differential across the plug 31, so that the plug 31 moves.

By simultaneously it is meant that the breaking of the preventer release element 13 and the breaking of the plug release element 33 occurs when the pressure reaches the threshold needed for the preventer release element 13. It is possible that there is a delay in the actual moving of the soft open preventer 10 and movement of the plug assembly 30. As mentioned previously soft open preventer 10 and the downhole tool 40 can be activated simultaneously.

Figure 2D:
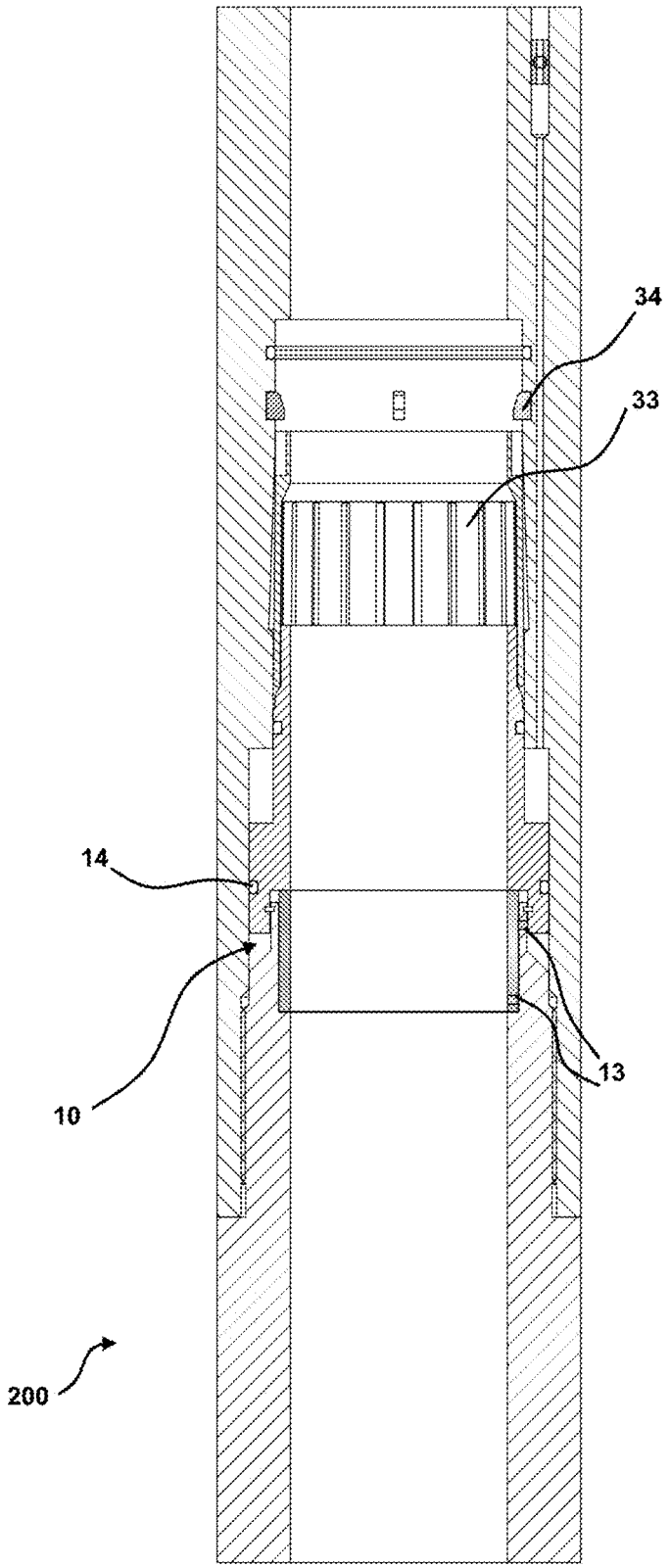
FIG. 2D discloses a closeup cross sectional view of an example of a soft open preventer system in the fourth position.

FIG. 2D discloses the same view as FIGS. 2A-2C, but the soft open preventer system 200 is in the fourth position. In the fourth position, the soft open preventer 10 has moved as the preventer release element 13 has broken and the plug release element 33 has collapsed. The final result of this is that the plug 31 is broken on the breaker object 34 and fluid flow has been restored through the soft open preventer system 200. The snap ring 14 locks the soft open preventer 10 in place so that it is not possible for move back toward the uphole side.

The preventer support 11 and preventer sleeve 12 of the soft open preventer 10 can be made of a single piece. This will be considered the preventer support 11. Note that the snap ring 14 is an optional element. Also, the preventer release element 13 is shown as a shear pin, but can be a shear screw, shear ring, or other shear element. These are examples of sleeve release elements 13 that operate by a force transverse to the body of the element that causes a shearing. Also note that it can be an element that is arranged to break due to tensile force being applied between a fixed and a movable element. This is an example of a preventer release element 13 that breaks due to a force on the element by stretching. The preventer release element 13 can also be an element that crumples due to forces that compress the element, usually in the axial direction (but radially is possible). Another example of a preventer release element 13 is a spring requires a certain threshold force to compress.

The preventer support 11 can be made of multiple pieces. For example, there could be a piece that took pressure applied through channel 21 and transmitted that to the preventer release element 13, and a second portion that prevents the plug assembly 30 from activating. This can be generalized to the preventer support 11 from allowing the downhole tool 40 to activate (discussed later in FIGS. 8A-10). There can be intermediate pieces of the preventer support 11 as well to serve other functions or to connect the other portions together.

The preventer release element 13 does not have to be between the preventer sleeve 12 and the downstream tubular 102. It can be arranged between any portion of the soft open preventer 10 and the preventer tubular 100, or between the soft open preventer 10 and something that is stationary with respect to the preventer tubular 100. It is also possible for the preventer release element 13 to be between the soft open preventer 10 and the plug release element 33. One advantage of this is to reduce the number of elements needed in the soft open preventer system 200.

While the figures show that the plug assembly 30 includes a plug 31 release element 33, this plug release element 33 is optional. It is possible for the channel system 20 to support the plug 31 by acting as a seat 32 or supporting the seat 32. Additionally, the breaker object 34 can be arranged above the seat 32 such that the breaker object 34 strikes a plug 31 that is not moving with respect to the plug 31. Normally, this will be because the plug 31 is stationary with respect to the housing. Note that the breaker object 34 can be a separate element that is moved when the soft open preventer 10 moves, or part of the soft open preventer 10 itself. FIG. 2B describes the case where the preventer release element 13 and plug release element 33 are set at different pressure differential thresholds. If the preventer release element 13 is set at the same pressure differential threshold as the plug release element 33, the plug 31 will break as soon as the preventer release element 13 breaks. However, it may be desirable for the plug release element 33 to be set so that the breaking of the plug 31 will be ensured, but not occur at a higher than needed to release the preventer support 11.

The channel 21 is arranged in the walls of the preventer tubular 100. However, it made be made by a separate element that is attached a location stationary with respect to housing, to form a channel 21. Another option would be a separate element that has a channel 21 entirely contained within it. Additionally, a channel 21 can be arranged in the annulus. Any combination of the channel 21 being made up of individual sections of the aforementioned ways to form a channel 21 is possible.

The tension type plug release element 33 of the FIGS. 2A-2C and 6A-6B is not the only option for a plug release element 33, as mentioned previously. Rather the plug release fingers 332 tensioned outwards, it could also be tensioned inwards. A shear type plug release element is also possible. Another example is an electronic trigger.

The figures show the preventer release element 13 between the preventer sleeve 12 and the preventer tubular 100 (in the housing 35 in this case). Another stationary element with respect to the preventer tubular 100 would also function. However, the preventer release element 13 can be placed between the preventer support 11 and a stationary element (or directly into the housing 35 or preventer tubular 100).

While the figures show that there is only a preventer release element 13, it is possible to have more than one. Additionally, it is possible to have multiple different types of preventer release element 13 in the same soft open preventer 10.

Figure 3:
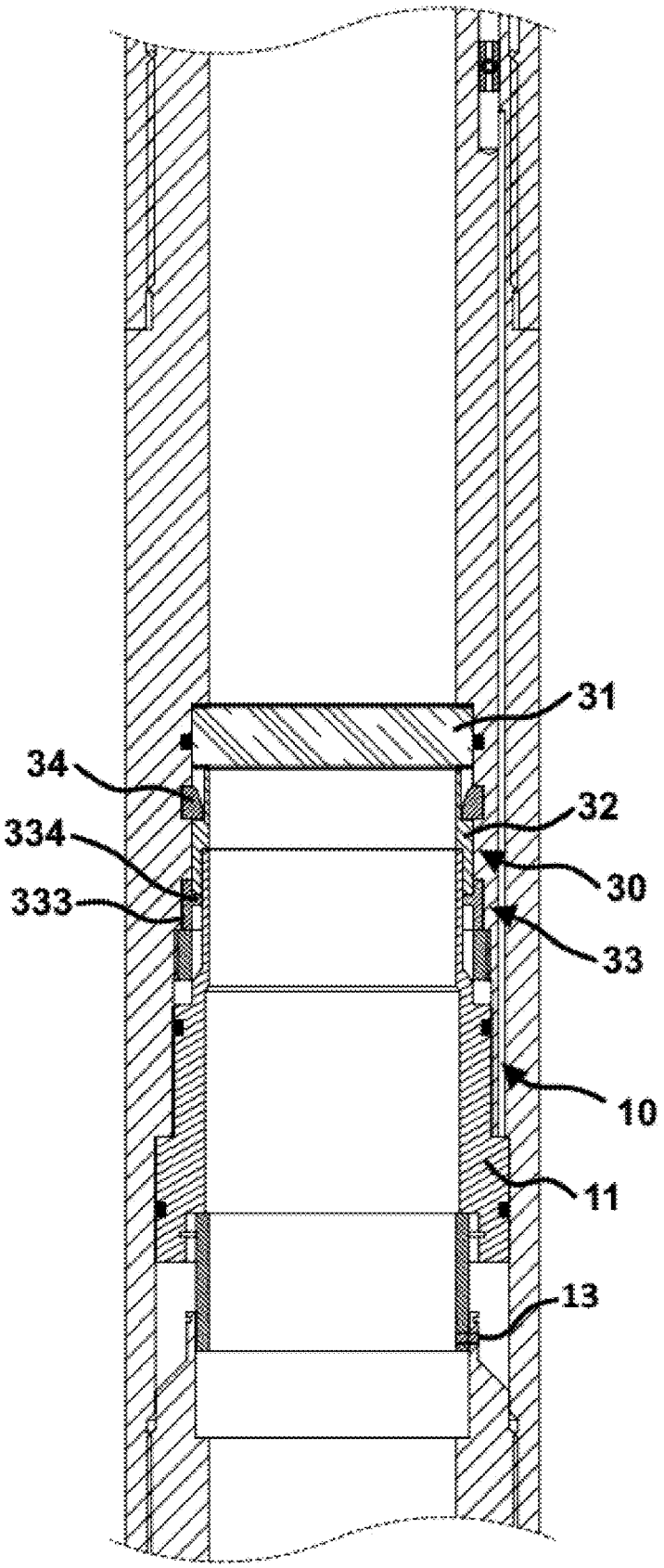
FIG. 3 discloses a cross-sectional view of a second example of a soft open preventer system with a different plug assembly.

Reference is made to FIG. 3. FIG. 3 discloses another example of the soft open preventer 10 in the first position. The plug assembly 30 is different than that in FIG. 2A-2D. As before, the plug 31 is supported by the seat 32. A breaker object 34 is arranged to break the plug 31 upon contact.

Unlike in the previous example, seat 32 rests on the plug release element 33. In this case the plug release element 33 is a shear ring, rather than a tension element. When the threshold differential pressure across the shear ring, the shear ring breaks into two or more pieces and releases the seat 32. This results in the plug 31 and seat 32 moving axially, the plug 31 impacting the breaker object 34, and the plug 31 breaking.

This shear ring kind of plug release element 33 has two pieces. The first is that which remains stationary and does not receive the load from seat 32, the shear ring body 333. The second is the part that receives the load from the seat 32 and is the shear ring lip 334. This is the same for other kinds of shearing based plug release elements 33 including shear pins.

As usual, the soft open preventer 10 prevents the plug 31 from breaking early by preventing it from moving. In the specific example shown in the figure, it is arranged to prevent seat 32 from moving. Another way would be for preventer support 11 to support the shear ring lip 334.

Figure 4:
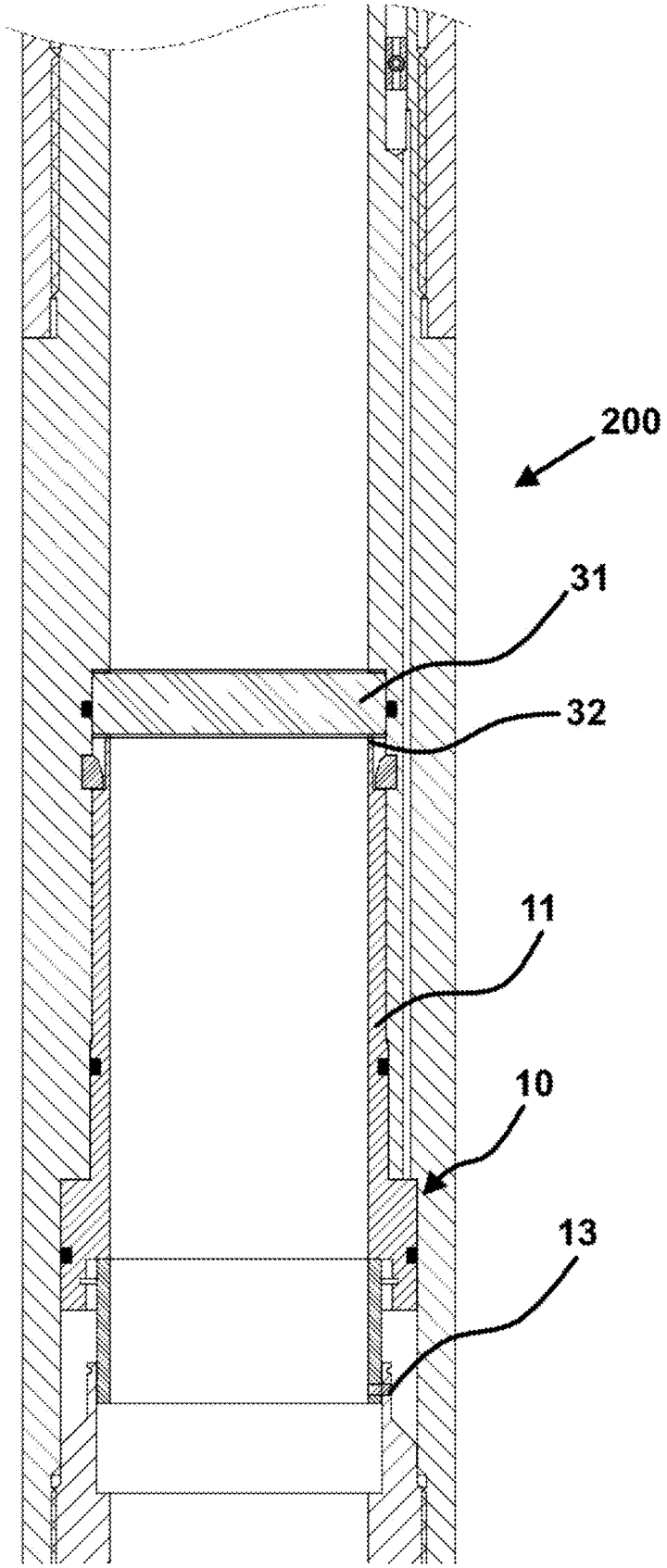
FIG. 4 discloses a cross-sectional view of a third example of a soft open preventer system with a different seat.

Reference is made to FIG. 4. FIG. 4 discloses another example of a soft open preventer system 200 with a plug assembly. As discussed previously, it is possible for the preventer release element 13 and the plug release element 33 (not shown) to be arranged such that when the threshold differential pressure in channel 21 is reached, the preventer release element 13 breaks and the soft open preventer 10 moves.

In this example, the plug assembly 30 does not have a plug release element 33 and the movement of the plug 31 is entirely dependent on the preventer release element 13 breaking. The soft open preventer 10 (in the example specifically the preventer support 11) is seat 32 on which the plug 31 rests. When the preventer release element 13 breaks, the soft open preventer 10 moves and brings the breaker object 34 into contact with the plug 31.

This shows that the plug release element 33 is an optional element and only preventer release element 13 is needed. In this case, it can be thought that the combination of a plug release element 33 and the preventer release element 13, is simply the preventer release element 13.

Reference is made to FIGS. 5A and 5B. FIGS. 5A and 5B disclose another example of a soft open preventer system 200. In this example, the plug 31 does not move with respect to the preventer tubular 100. The plug assembly 30 also lacks a plug release element 33. One of the most common ways to break a plug 31 is to use an explosive.

In FIG. 5A, the soft open preventer system 200 is the initial position where the plug 31 is not broken and the preventer release element 13 has not broken. This example discloses an application of the soft open preventer 10 to break a plug 31 that is stationary. The plug 31 rests on the seat 32. The seat 32 is stationary with respect to the plug 31 in each operational position of the soft open preventer system 200 (determined by movement of the plug assembly 30 and soft open preventer 10).

In FIG. 5B, the pressure in the channel system 20 is above a threshold differential pressure, and the soft open preventer 10 moves. Specifically, FIG. 5B shows the movement from the initial position to where the breaker object 34 impacts the plug 31. After the soft open preventer 10 activates, the breaker object 34 moves and breaks the plug 31.

In the example shown, a breaker assembly 37 comprises at breaker object 34, a breaker support 38, and a breaker body 39. The breaker assembly 37 is arranged to move (activate) when the soft open preventer 10 activates. In this specific example the breaker body 39 rests upon the preventer support 11, the breaker support 38 is supported by the breaker body 39. The breaker support 38 contains the breaker object 34. When the soft open preventer 10 activates, the preventer support 11 moves causing the breaker body 39 to move. Thus, the breaker support 38 and breaker object 34 move as well. To ease installation, the breaker support 38, could be made of a plurality of segments.

In the configuration where the plug 31 is stationary, the seat 32 means an element that remains fixed with respect to the preventer tubular 100. This can be as simple as a portion of the preventer tubular 100 that protrudes so that the plug 31 can rest upon it. The seat 32 can also be a separate element as shown in FIGS. 5A and 5B.

It is possible for the breaker object 34 to be part of the preventer support 11 itself. By breaker support 38 it is meant what the breaker object 34 is mounted to or in. This does not only hold true for this example, but all of those that contain a breaker object 34.

Note that in this configuration there is no third position as the plug assembly 30 does not contain a plug release element 33. However, it would be possible to have a release element on the breaker assembly 37. For example, this release element could be placed on the breaker body 39.

The plug 31 is usually stationary. However, in this example, breaking could also happen if both the plug 31 and breaker assembly 37 move. In this case, the breaker object 34 would move faster than the plug 31.

Note that the breaker body 39 could be part of the breaker support 38 and/or part of the soft open preventer 10. The breaker body 39 can have more shapes than that of a rod. Other examples could include sleeves, half sleeves, or other things that keep the breaker object 34 moving uninterrupted until it impacts the plug 31.

Figures 6A, 6B:
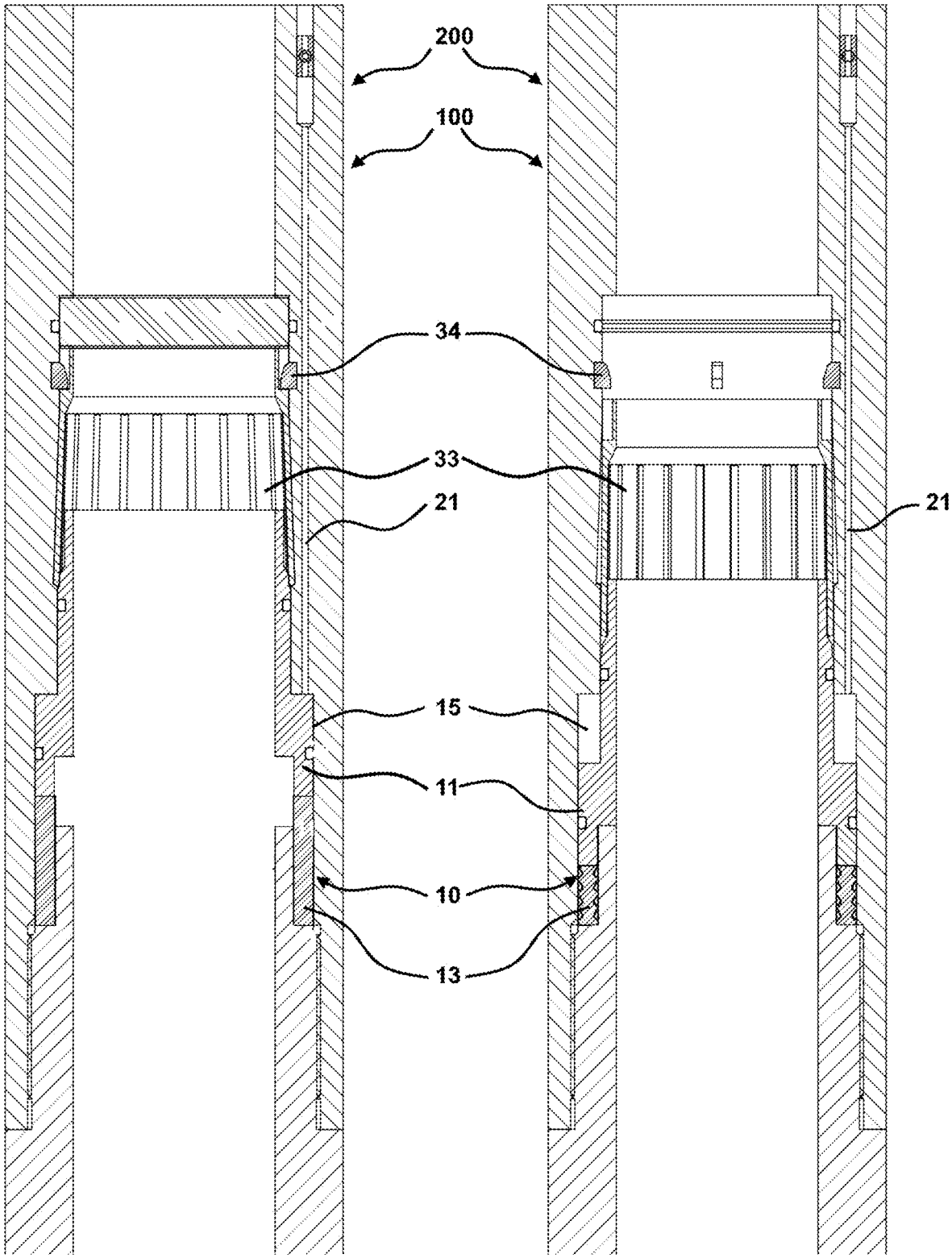
FIG. 6 discloses a cross-sectional view of a fifth example of a soft open preventer system with a crumple element.

Reference is made to FIGS. 6A and 6B. FIG. 6 discloses another example of a soft open preventer system 200. In the previous figures, the preventer release element 13 was a shear element (pin, screw, ring, etc) between the preventer sleeve 12 and a stationary element with respect to the preventer tubular 100 (in this case the downstream tubular 102). In this example, the preventer release element 13 is a crumple element. There is no preventer sleeve 12 and the preventer support 11 is supported by the preventer release element 13. Pressure in channel system 20 causes the preventer release element 13 to compress or break. Once the preventer release element 13 compresses, the preventer support 11 is free to move downwards, the plug 31 is free to move and impacts the breaker object 34.

FIG. 6A discloses the soft open preventer system 200 in the initial state (first position), where the both the preventer release element 13 and plug release element 33 are unbroken, the soft open preventer 10 doesn't move and the plug 31 is not broken.

FIG. 6B discloses the soft open preventer system 200 in the final state (fourth position) where both the preventer release element 13 and plug release element 33 have broken, the plug 31 has been in contact with the breaker object, and the plug is broken.

FIGS. 6A and 6B disclose that the preventer release element 13 is arranged in the preventer gap 15. An alternative is to arrange release element 13 outside of the preventer gap 15, which is shown filled in FIG. 6A and not filled in FIG. 6B as the preventer release element 13 crumples. Another possibility is that the preventer release element 13 is a portion of the preventer support 11 or preventer sleeve 12, as mentioned previously the preventer support 11 and preventer sleeve 12 can be a single element in the soft open preventer 10.

While the figures show that the preventer release element 13 is below the preventer support 11, the preventer release element 13 does not experience the pressure in the channel 21 directly. The preventer support 11 can also be placed so that the fluid pressure of the channel system 20 is directly on the preventer release element 13 and not on the preventer support 11 as in the figures.

Figure 7A:
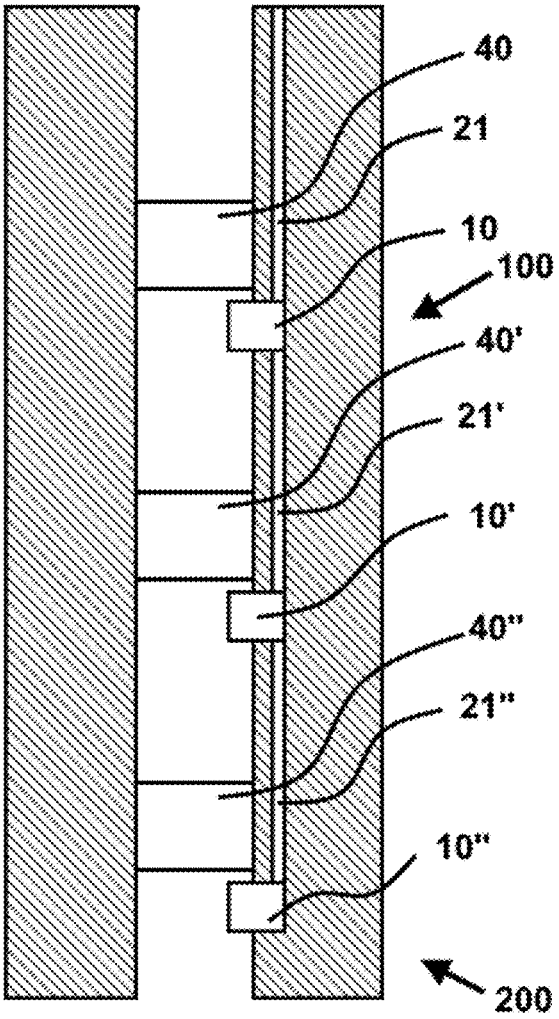
FIG. 7A-B discloses a cross-sectional view of a seventh and eight examples of a soft open preventer system with multiple channel systems in different configurations.
Figure 7B:
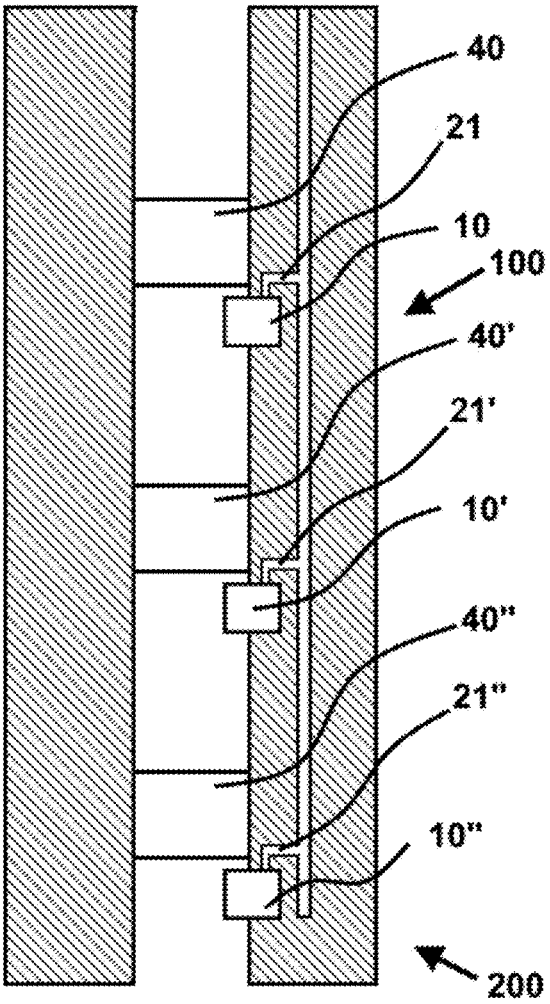

Reference is made to FIGS. 7A and 7B. FIGS. 7A and 7B disclose another example of a soft open preventer system 200. These are both examples of how a soft open preventer 10 can be used to activate multiple downhole tools 40,40', 40" at different pressures. Each discloses three tools that, each with their own soft open preventer 10,10',10" is in fluid contact with a channel 21. It is possible to use a soft open preventer 10 for more than just activating a single tool.

FIG. 7A discloses a simple schematic of three soft open preventers 10,10',10" all connected to individual channels 21,21',21" in a sequential manner. After the first soft open preventer 10 moves due to pressure from the first channel 21 (exposing the first downhole tool 40 to pressure), it exposes the second soft open preventer 10' to pressure through the second channel 21'. After the second soft open preventer 10' moves (and exposes the second downhole tool 40' to pressure), it exposes the third soft open preventer 10" to the pressure from third channel 21" (and triggers the third downhole tool 40"). In this way, the tools can be triggered in a sequential manner.

FIG. 7B discloses three soft open preventers 10,10',10" that are connected in a parallel manner. Each of the soft open preventers 10,10',10" have their own channel 21,21',21". In this way the soft open preventer 10,10',10" can be operated independently giving the possibility of, for example, the first second soft open preventer 10' being triggered before the first soft open preventer 10.

Note that as previously discussed, the downhole tool 40 does not have to trigger at the same time as the soft open preventer 10 does. The soft open preventer 10 simply prevents the premature triggering of the downhole tool 40 due to pressure.

A combination of the linear and parallel configurations is possible. For example, the first soft open preventer 10 and the third soft open preventer 10" could be in parallel, with the second soft open preventer 10' being in series with the first soft open preventer 10. It is also possible to have more than one downhole tool 40, that doesn't not need a channel 21 at all. For example, if a plug 31 in a plug assembly 30 breaks, this could expose another downhole tool 40' to enough pressure that it will trigger, even without an individual soft open preventer 10 for it. In other words, two downhole tools 40 can be on the same soft open preventer 10.

Both the linear and parallel configurations (shown in FIGS. 7A and 7B) of the soft open preventer 10,10',10" can be arranged such that the same pressure can make two or more of the downhole tool 40,40',40" activate. Note that if one of the three downhole tools 40,40',40" does not activate in this case, even when it was supposed to be at the same pressure for activation, pressure through one of the fluid channels 21,21',21" can be increased until it does.

Normally the downhole tool 40 has a tool release element 43. This can be the same type of release element as was described earlier for preventer release element 13 and plug release element 33.

One example of a downhole tool 40 discussed in detail previously, is a plug assembly 30. This is to prevent the plug assembly 30 from breaking the plug 31 when there is not enough force to break it. Other examples of a downhole tool 40 is a sleeve, such as a sleeve with a bypass channel.

Note that the preventer release element 13 type of one soft open preventer 10 may be different as for another soft open preventer 10'. In other words, in the first soft open preventer 10 it could be a shear pin and in the second soft open preventer 10' it could be a tensile element.

Figure 8:
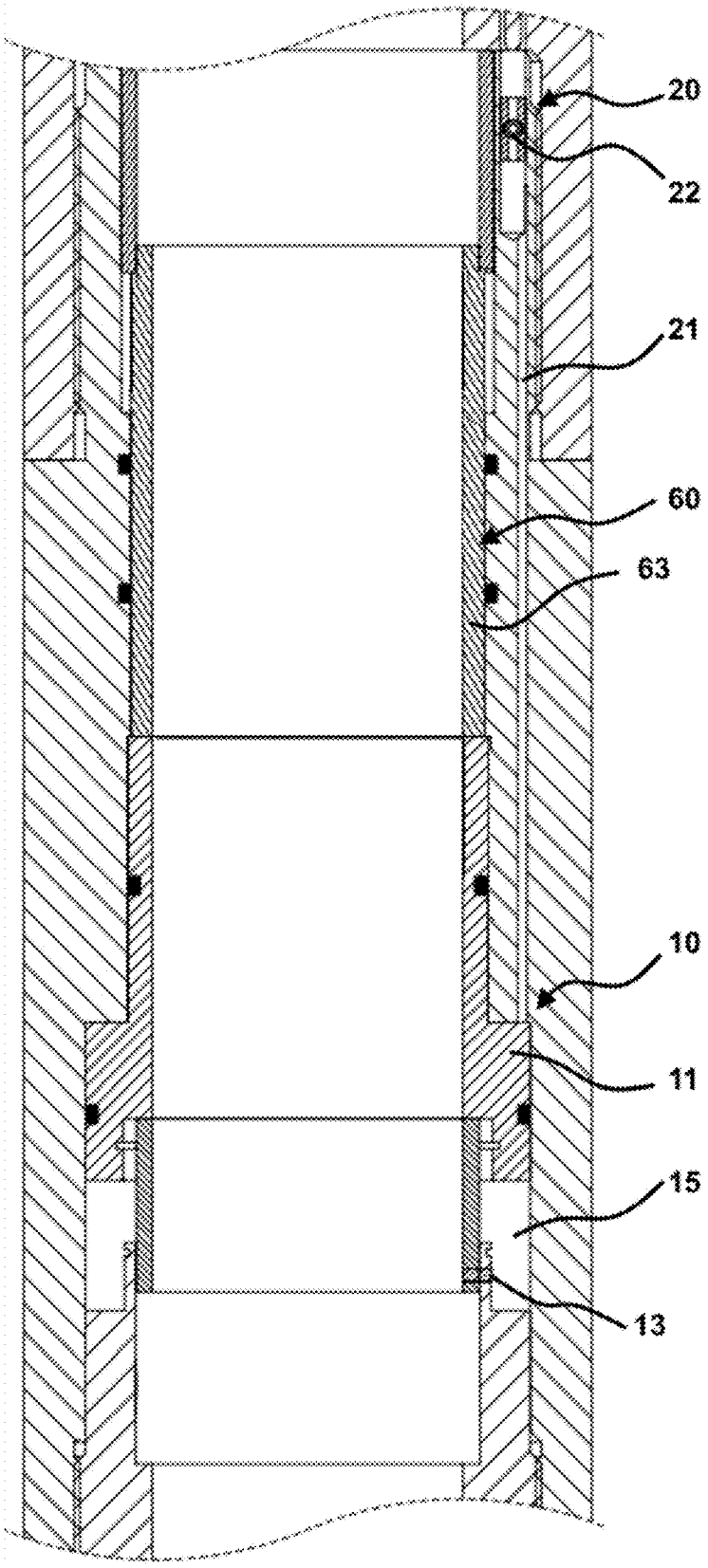
FIG. 8 discloses a cross-sectional view of a ninth example of a soft open preventer system with a sleeve.

Reference is made to FIG. 8. FIG. 8 discloses the use of the soft open preventer 10 to actuate a sleeve 60.

It is possible for the sleeve 60 to comprise a sleeve release element 63 if the purpose of the soft open preventer 10 is simply to ensure that the sleeve 60 (or any other downhole tool 40) does not activate early. However, in the example shown, there is no sleeve release element 63, only a preventer release element 13). It can be considered that the sleeve release element 63 is the preventer release element 13.

Upon activation of the channel release 22, pressure in the channel 21 will eventually cause the soft open preventer 10 to activate. This causes the preventer support 11 to move into the preventer gap 15. This movement into the preventer gap 15 allows for the sleeve 60 to move.

The preventer gap 15 will often be a sealed chamber, but this is not a requirement.

Several downhole tools 40 include a sleeve 60 of some kind within them. It would be possible to modify a soft open preventer 10 in the soft open preventer system 200 such that activation of the soft open preventer 10 activates the sleeve 60, which causes the downhole tool 40 to activate.

Figure 9:
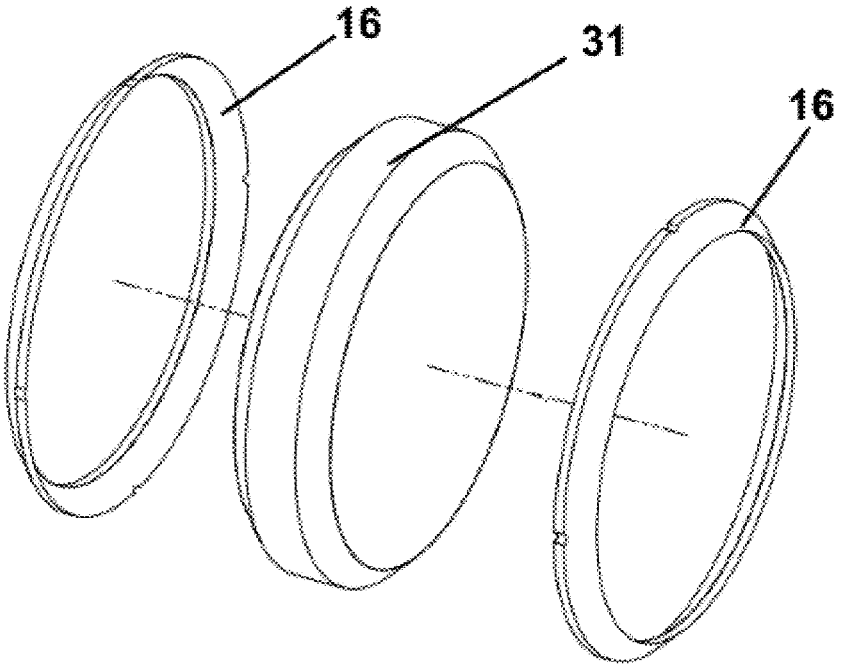
FIG. 9 discloses a perspective view of an alternative shape of a plug with sealing elements.

Reference is made to FIG. 9. FIG. 9 discloses a perspective view of an alternative shape of a plug 31. All of the plugs shown have had a square cross section and O-rings sealing on the side. However, this does not have to be the case and FIG. 9 present an alternative shape of plug. In this case, the plug has been chamfered on both the top and bottom. In this case, there are bearing rings 16 on the angled sides.

Without the bearing ring 16, it is possible for the plug to break prematurely on the hard metal components that hold the plug in position. Sealing of the plug can be done with an O-ring (and other sealing elements) around its circumference, as in the previous figures. An alternative is to use bearing rings 16 that seal. Note that it is possible to use a single bearing ring 16 that seals.

Also, note that it is possible for only the top or bottom of the plug 31 to be chamfered. It is not required that there are two bearing rings. It is also possible to have a bearing ring that is not angled. It is possible to combine a sealing bearing ring 16 with an O-ring. The O-ring is usually located around the circumference, but it can be along the edge of the chamfered plug.

In a more general description of the different positional states of the soft open preventer system 200, is given as:

- In first position of the soft open preventer system 200 (as shown for a plug assembly 30 in FIG. 2A):
  - The soft open preventer 10 is in its first position (not moving)
  - The downhole tool 40 (in this case a plug assembly 30) is in its second position (not moving)
- In second position of the soft open preventer system 200 (as shown for a plug assembly 30 in FIG. 2B):
  - The soft open preventer 10 has activated (in this case the preventer release element 13 breaks) and moves from its first position (stationary) through an intermediate position and stops in the second position.
  - The downhole tool 40 is still in its second position.
- In third position of the soft open preventer system 200 (as shown for a plug assembly 30 in FIG. 2C):
  - The soft open preventer 10 is in its second position (stationary)
  - The downhole tool 40 has activated and moves into an intermediate position between the first position (stationary) and the third position (in which the downhole tool 40 has finished activating).
- In fourth position of the soft open preventer system 200 (as shown for a plug assembly 30 in FIG. 2D)
  - The soft open preventer 10 is in its second position
  - The downhole tool 40 has finished activating (moving from its first position, through its second position) and is at rest.

However, that is not the only application of the soft open preventer 10. Another application is using the activation of a soft open preventer 10 to activate a downhole tool 40 by at a certain threshold differential pressure or absolute pressure being applied. Many downhole tools 40 include sleeves that are moved when the downhole tool 40 activates after or with the activation of the soft open preventer 10.

In most of the previous examples, both the soft open preventer 10 and plug assembly 30 operate on a differential pressure. Configurations using release elements or a crumple element were triggered on absolute pressure (shown in FIGS. 6A and 6B). One skilled in the art would easily be able to modify the soft open preventer 10 and the downhole tool 40 to operate at a threshold absolute pressure instead of a threshold differential pressure. This usually means configuring the preventer release element 13 and tool release element 43 such that it breaks at a threshold absolute pressure.

Note that the preventer release element 13, plug release element 33, tool release element 43, and sleeve release element 63 can all be made using (independently) the previously discussed types of release elements 13,33,43,63.

Another use of the soft open preventer 10 is in a tool that can be activated in two steps. For example a downhole tool 40 that is activated in two steps. For example a safety feature that something cannot happen before a certain pressure has been applied.

Note that the term "activation" means that the tool moves from one state to another, be it any of the examples of downhole tools 40 (examples include a plug assembly 30 and a sleeve 60) or the soft open preventer 10. These activations do not have to occur at the same time. Additionally, if a downhole tool's 40 tool release element 43 is referred to as the same as the preventer release element 13, it means that the tool release element 43 does not exist and only the preventer release element 13 is responsible for the activation of the soft open preventer 10 and downhole tool 40.

As has been shown in this disclosure, the soft open preventer 10 can be used for more than preventing the opening of a tool early. In the case where the preventer release element 13 and the tool release element 43 are the same, the soft open preventer 10 becomes a way to activate the downhole tool 40 when the possibility of soft opening itself is not a problem.

The invention claimed is:

1. A soft open preventer system (200) comprising:
a preventer tubular (100),
a soft open preventer (10),
a channel system (20),
a downhole tool (40),
the soft open preventer (10) comprises:
a preventer support (11), and
a preventer release element (13),
the channel system (20) comprises:
a channel (21),
a channel release (22), and
pressure applier (23);

the downhole tool (40) comprises:

a tool release element (43);

wherein:

the soft open preventer (10), the downhole tool (40), and the channel system (20) is arranged at least partially in the preventer tubular (100); and the soft open preventer (10) is arranged such that the downhole tool (40) will not activate before the soft open preventer (10) activates;

the pressure applier (23) is arranged to activate the channel release (22), the channel release (22) is arranged to allow pressure to increase in the channel (21);

the channel (21) is in fluid contact with at least a portion of the preventer support (11), and the preventer release element (13) supports the preventer support (11);

wherein:

the preventer release element (13) is arranged such that when a threshold absolute pressure or pressure differential is applied to the preventer release element (13), the preventer release element (13) breaks activating the soft open preventer (10), allowing the preventer support (11) to move; and the soft open preventer system (200) is arranged such that activation of the soft open preventer (10) will allow the activation of the downhole tool (40).

2. The soft open preventer system (200) according to claim 1, wherein the downhole tool (40) further comprises a tool release element (43), wherein the downhole tool (40) activates when the tool release element (43) breaks.

3. The soft open preventer system (200) according to claim 2, wherein the preventer release element (13) and the tool release element (43) is a single element.

4. The soft open preventer system (200) according to claim 1, wherein the soft open preventer (10) further comprises a preventer sleeve (12) that supports the preventer support (11).

5. The soft open preventer system (200) according to claim 1, wherein the pressure applier (23) is a counter or an electronic trigger.

6. The soft open preventer system (200) according to claim 1, wherein the preventer release element (13) or the tool release element (43) is a shear element, a tension element, a tensile element, or a crumple element.

7. The soft open preventer system (200) according to claim 4, wherein the preventer support (11) and the preventer sleeve (12) are a single element.

8. The soft open preventer system (200) according to claim 1, wherein the downhole tool (40) is a plug assembly (30), wherein the plug assembly (30) comprises:

a plug (31) that blocks fluid flow through the preventer tubular (100) when the plug (31) is intact; and a seat (32) that supports the plug (31), a breaker object (34) arranged to break the plug (31).

9. The soft open preventer system (200) according to claim 8, further comprising a sealing bearing ring (16) in contact with the plug (31).

10. The soft open preventer system (200) according to claim 8, wherein the tool release element (43) is a plug release element (33) arranged to bring the breaker object (34) in contact with the plug (31) when the plug release element (33) breaks.

11. The soft open preventer system (200) according to claim 8, wherein the preventer support (11) supports the seat (32), preferably where the seat (32) and the preventer support (11) is a single element.

12. The soft open preventer system (200) according to claim 8, wherein a plug release element (33) is the preventer release element (13).

13. The soft open preventer system (200) according to claim 8, wherein the plug assembly (30) further comprises a breaker body (39) arranged to support the breaker object (34), and wherein the breaker body (39) is supported by the soft open preventer (10), preferably the plug (31) is stationary.

14. The soft open preventer system (200) according to claim 1, wherein the downhole tool (40) comprises a sleeve (60) and wherein the soft open preventer system (200) is arranged such that activation of the sleeve (60) activates the downhole tool (40).

15. The soft open preventer system (200) according to claim 9, wherein a plug release element (33) is the preventer release element (13).

16. The soft open preventer system (200) according to claim 10, wherein the plug release element (33) is the preventer release element (13).

17. The soft open preventer system (200) according to claim 9, wherein the preventer support (11) supports the seat (32), preferably where the seat (32) and the preventer support (11) is a single element.

18. The soft open preventer system (200) according to claim 10, wherein the preventer support (11) supports the seat (32), preferably where the seat (32) and the preventer support (11) is a single element.

19. The soft open preventer system (200) according to claim 2, wherein the soft open preventer (10) further comprises a preventer sleeve (12) that supports the preventer support (11).

20. The soft open preventer system (200) according to claim 1, wherein the soft open preventer system (200) further comprises:

a second downhole tool (40'), a second channel (21'), and a second soft open preventer (10');

wherein the soft open preventer system (200) is arranged such that:

the second channel (21') is in fluid connection with the channel (21) after or before the first soft open preventer (10) activates, and the channel second channel (21') is in fluid connection with the second soft open preventer (10').

* * * * *